US010024233B2

(12) United States Patent
Hoehl

(10) Patent No.: US 10,024,233 B2
(45) Date of Patent: Jul. 17, 2018

(54) RECIPROCATING PISTON INTERNAL COMBUSTION ENGINE

(71) Applicant: Bayerische Motoren Werke Aktiengesellschaft, Munich (DE)

(72) Inventor: Johannes Hoehl, Maisach (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 14/885,327

(22) Filed: Oct. 16, 2015

(65) Prior Publication Data

US 2016/0097322 A1 Apr. 7, 2016

Related U.S. Application Data

(63) Continuation of application No. PCT/EP2014/058544, filed on Apr. 28, 2014.

(30) Foreign Application Priority Data

Jun. 5, 2013 (DE) ..... 10 2013 210 471

(51) Int. Cl.
*F02B 75/22* (2006.01)
*F01B 1/06* (2006.01)
(Continued)

(52) U.S. Cl.
CPC ..... *F02B 75/224* (2013.01); *F01B 1/06* (2013.01); *F02B 61/02* (2013.01); *F02B 75/18* (2013.01); *F02B 2075/1812* (2013.01)

(58) Field of Classification Search
CPC ..... F02B 75/22; F02B 75/224; F02B 75/18; F02B 61/02; F02B 25/28;
(Continued)

(56) References Cited

U.S. PATENT DOCUMENTS

D417,674 S 12/1999 Feuling
6,058,901 A * 5/2000 Lee ..... F02B 75/22 123/197.1
(Continued)

FOREIGN PATENT DOCUMENTS

AT 003 397 U1 4/1999
DE 29 04 066 A1 8/1980
(Continued)

OTHER PUBLICATIONS

International Search Report (PCT/ISA/210) issued in counterpart International Application No. PCT/EP2014/058544 dated Jul. 9, 2014, with English translation (Four (4) pages).
(Continued)

*Primary Examiner* — Grant Moubry
(74) *Attorney, Agent, or Firm* — Crowell & Moring LLP

(57) ABSTRACT

A reciprocating piston internal combustion engine includes at least one first, one second and one third cylinder and has a crank mechanism having a crankshaft, which is rotatably mounted in a crankcase, having a first, a second and a third crankpin. A first connecting rod having a first piston for the first cylinder is allocated to the first crankpin. A second connecting rod having a second piston for the second cylinder is allocated to the second crankpin. A third connecting rod having a third piston for the third cylinder is allocated to the third crankpin. The crankpins are arranged successively in an axial direction of the crankshaft, wherein the cylinders are arranged in a fan shape.

20 Claims, 2 Drawing Sheets

(51) Int. Cl.
*F02B 61/02* (2006.01)
*F02B 75/18* (2006.01)

(58) Field of Classification Search
CPC .... F02B 2075/1812; F01B 1/06; F01B 1/062; F01B 1/0641; F01B 1/0668; F16F 15/264
USPC ..... 123/52.1, 54.1, 54.4, 54.5, 197.4, 193.1, 123/193.2
See application file for complete search history.

(56) References Cited

U.S. PATENT DOCUMENTS 6,257,178 B1 * 7/2001 Laimbock ..... B62K 11/04 123/54.1
D449,620 S 10/2001 Feuling
7,234,432 B2 * 6/2007 Nagira ..... F16C 3/20 123/192.2
7,513,224 B2 * 4/2009 Heaton ..... B64D 27/24 123/51 R
8,371,210 B2 * 2/2013 Raffaele ..... F01B 9/023 92/129
8,627,790 B2 * 1/2014 Laimboeck ..... F02B 75/02 123/52.1

FOREIGN PATENT DOCUMENTS

DE 30 45 974 A1 7/1982
DE 10 2008 020 423 A1 10/2009
EP 0 999 356 A2 5/2000
GB 687687 A 2/1953
JP 3-37453 A 2/1991

OTHER PUBLICATIONS

German Search Report issued in counterpart German Application No. 10 2013 210 471.5 dated Feb. 6, 2014, with English translation (Ten (10) pages).

* cited by examiner

RECIPROCATING PISTON INTERNAL COMBUSTION ENGINE

CROSS REFERENCE TO RELATED APPLICATIONS

This application is a continuation of PCT International Application No. PCT/EP2014/058544, filed Apr. 28, 2014, which claims priority under 35 U.S.C. § 119 from German Patent Application No. 10 2013 210 471.5, filed Jun. 5, 2013, the entire disclosures of which are herein expressly incorporated by reference.

BACKGROUND AND SUMMARY OF THE INVENTION

The invention relates to a reciprocating piston internal combustion engine.

With respect to the technical background, reference is made, for example, to the globally known Harley-Davidson V-twin internal combustion engines with their typical "two-cylinder sound" for Harley-Davidson motorcycles.

A further development of the globally famous V-twin reciprocating piston internal combustion engines took place by way of Jim Feuling's so-called "W3 project". In this project, in which, as in a V-twin internal combustion engine, the two cylinders are arranged behind one another in a V-shaped manner and the connecting rods act on a common crankpin journal of the crankshaft, Feuling's design has three cylinders, however, which evoke a "W"; hence the "W3" designation. Feuling constructed a novel crankcase, onto which a third cylinder including cylinder head is mounted into the V offset by 45°. The three cylinders together define a single plane. This was made possible by the use of a main connecting rod and two auxiliary connecting rods which share a common crankpin journal of the crankshaft. This is a design which is also still used today in aircraft reciprocating piston internal combustion engines with a radial cylinder arrangement (radial engines). Feuling's globally famous exceptional design is protected firstly by U.S. design Pat. D449,620 S and secondly by U.S. design Pat. Des. 417,674.

A disadvantage of Feuling's W3 design is the large cylinder angle which requires a relatively large amount of installation space.

Another way of implementing a three-cylinder reciprocating piston internal combustion engine is described by German laid open specification DE 10 2008 020 423 A1. This laid open specification discloses a reciprocating piston internal combustion engine with three cylinders in a V-arrangement, in particular for use in a motorcycle. The reciprocating piston internal combustion engine includes a crankshaft and a first outer cylinder, a second outer cylinder and a middle cylinder. Each cylinder is assigned a piston and a connecting rod. The outer cylinders lie in a common plane which passes through the crankshaft axis, and the middle cylinder lies in a second plane which is inclined with respect to said plane and likewise passes through the crankshaft axis. The three-cylinder reciprocating piston internal combustion engine is distinguished by the fact that the crankshaft has two crankpin journals and the connecting rods of the first outer cylinder and of the middle cylinder act jointly on the first crankpin journal and the connecting rod of the second outer cylinder acts on the second crankpin journal.

A disadvantage of the three-cylinder reciprocating piston internal combustion engine which is known from DE 10 2008 020 423 A1 is the relatively large overall width, which has a disadvantageous effect, in particular, when used for a motorcycle.

A further possibility for realizing a three-cylinder reciprocating piston internal combustion engine was shown as early as 1909 by Anzani with his fan-type reciprocating piston internal combustion engine for aircraft. Using this fan-type reciprocating piston internal combustion engine, the Frenchman Blériot in his Blériot IX was the first to fly across the English Channel from France to England as early as 1909. The reciprocating piston internal combustion engine had 25 hp which was impressive at the time and a rotational speed of almost 1200 rpm. The aircraft made a substantial contribution to the development of the later commonplace aircraft design, the monoplane, in which the engine, the wings and, at the rear, a tailplane followed one another in the flying direction from front to back. A foot-operated rudder and an additional control stick for operating the elevator already then corresponded to the currently customary controls of aircraft. Approximately 800 aircraft of this type made it the most widely produced aircraft prior to 1914. In Anzani's design, all three cylinders lay in one plane, in a similar manner to Feuling's design, the outer cylinders defining an angle >90°.

A disadvantage of this design is once again the relatively large cylinder angle which requires a large amount of installation space.

A further possibility for realizing a fan-type machine is described in the Internet lexicon "Wikipedia", the free encyclopedia. It is stated there that the fan-type machine is a piston machine, in which the power units (power unit: piston, connecting rod, crankshaft throw) are distributed uniformly over half the circumference, in an analogous manner to the radial machine, where they are distributed over the entire circumference. Up to five-cylinder small compressors are customary, in which the connecting rods are arranged next to one another on a single crankshaft journal. Machines are talked about here instead of engines, since in this arrangement there can be (combustion) engines, compressors, pumps and steam machines. However, the pistons or cylinders, as in Feuling's design, also define a single plane in these embodiments.

A disadvantage of this known embodiment is the relatively wide overall design which is not suitable, in particular, for single track vehicles such as motorcycles.

It is an object of the present invention to provide a W3 reciprocating piston internal combustion engine, the cylinder angles of which can be dimensioned largely freely, in order to obtain an overall design which is as compact as possible.

This and other objects are achieved by a reciprocating piston internal combustion engine, having at least a first, a second and a third cylinder and having a crank mechanism with a crankshaft which is mounted rotatably in a crankcase. A first, a second and a third crankpin journal are provided. The first crankpin journal is assigned a first connecting rod with a first piston for the first cylinder. The second crankpin journal is assigned a second connecting rod with a second piston for the second cylinder. The third crankpin journal is assigned a third connecting rod with a third piston for the third cylinder. The crankpin journals are arranged behind one another in an axial orientation of the crankshaft, wherein the cylinders are arranged in a fan-shaped manner.

A type of W3 reciprocating piston internal combustion engine which is not yet known and the cylinder angles of which can be dimensioned largely freely is realized by way of the configuration according to the invention of the reciprocating piston internal combustion engine. "Fan-shaped" is understood to mean that each cylinder lies in a plane which is parallel to the further planes which are formed by the other cylinders. In comparison with other radial engines, the invention therefore makes a narrower cylinder angle possible in the case of the existing cylinder offset. The minimum cylinder angle is dependent on the cylinder offset, the spacing of the crankpin journals on the crankshaft. Moreover, on account of the possible cylinder angles, the invention makes it possible to implant a W3 engine virtually in the installation space of a V-twin engine; the overall width increases in a non-critical range. Accordingly, for a four-cylinder internal combustion engine, the cylinder angle of a W4 is only insubstantially greater than in the case of a V4. The sound of a V-twin internal combustion engine can likewise be replicated by way of an internal combustion engine of this type according to the invention; the sound can even be designed to be somewhat "fresher".

Particularly satisfactory rigidity of the crankshaft is achieved by providing, in each case, one bearing point between the crankpin journals.

A cylinder angle $\alpha$ of 20° to 90° between adjacent cylinders is a particularly preferred design range.

The at least two cylinder angles $\alpha$ have unequal angular dimensions in a further development of the invention. Even more design options are made possible as a result.

An embodiment wherein a mass balancing shaft, which can be driven by the crankshaft and is oriented parallel to the crankshaft, advantageously influences the running properties or the smooth running (NVH=noise, vibration, harshness) of the reciprocating piston internal combustion engine according to the invention.

The reciprocating piston internal combustion engine according to the invention is particularly preferably used for a single track vehicle, and can preferably be installed transversely with respect to a driving direction of the single track vehicle.

Other objects, advantages and novel features of the present invention will become apparent from the following detailed description of one or more preferred embodiments when considered in conjunction with the accompanying drawings.

DETAILED DESCRIPTION OF THE DRAWINGS

In the following text, the same designations apply for identical components in FIGS. 1 to 4.

Figure 1:
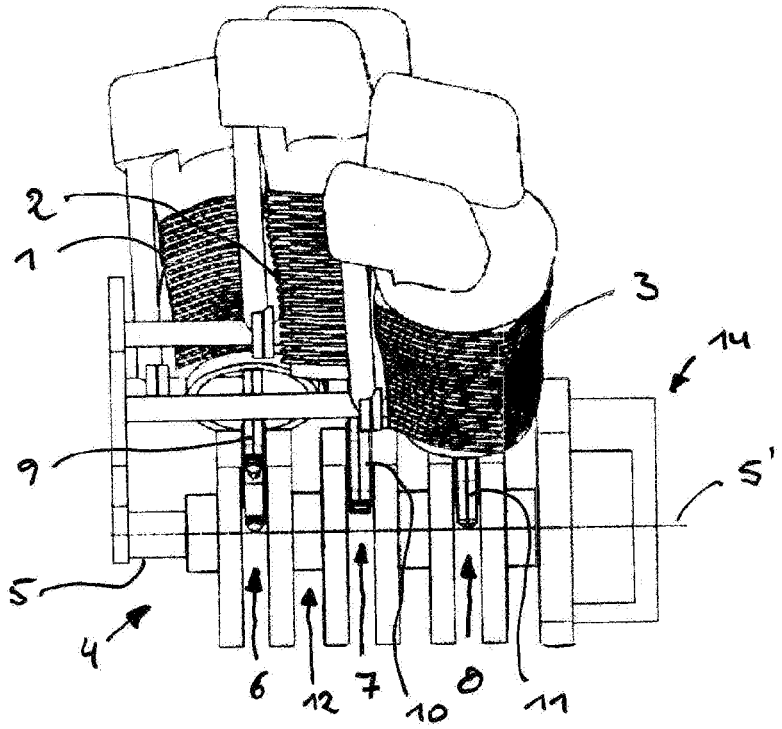
FIG. 1 is a front view of a reciprocating piston internal combustion engine according to an embodiment of the invention.

FIG. 1 shows a front view of a reciprocating piston internal combustion engine having at least a first, a second and a third cylinder 1, 2, 3. A crank mechanism 4 is shown without an encasing crankcase, with the result that the crank mechanism is freely visible. The crank mechanism 4 consists of a crankshaft 5, which is mounted rotatably in the crankcase (not shown), with a first, a second and a third crankpin journal 6, 7, 8. Here, the first crankpin journal 6 is assigned a first connecting rod 9 with a first piston for the first cylinder 1, the second crankpin journal 7 being assigned a second connecting rod 11 with a second piston for the second cylinder 2, and the third crankpin journal 8 being assigned a third connecting rod 13 with a third piston for the third cylinder 3. Since the pistons are mounted such that they can be moved in a reciprocating manner in the respective cylinders, they are concealed by the cylinders 1, 2, 3. Three cylinder heads and cylinder covers which are assigned to the cylinders 1, 2, 3, under which in each case a visible valve gear is arranged, are not provided with a designation in the figures.

As can be seen clearly in FIG. 1, the crankpin journals 6, 7, 8 are arranged behind one another or next to one another in an axial orientation of the crankshaft 5. On account of the axial orientation of the crankpin journals 6, 7, 8, the cylinders 1, 2, 3 are arranged in a fan-shaped manner according to the invention, as a result of which different cylinder angles $\alpha$ (shown in FIG. 3) can be realized structurally. Furthermore, an output 14, consisting, inter alia, of a gear mechanism (which is not shown in greater detail) is arranged on the crankshaft 5 in order to output the power generated by the reciprocating piston internal combustion engine. "Fan-shaped" is understood to mean that each cylinder lies in a plane which is parallel to the further planes which are formed by the other cylinders. One example for this is, for example, Japanese hand fans.

Furthermore, in each case one bearing point 12 is provided for the crankshaft 5 between the crankpin journals 6, 7, 8 for optimum rigidity of the crankshaft and the crankcase. Only one bearing point 12 is designated in FIG. 1. Bearing points can also be provided for the crankshaft in front of and behind the crankpin journals 6, 8.

Figure 2:
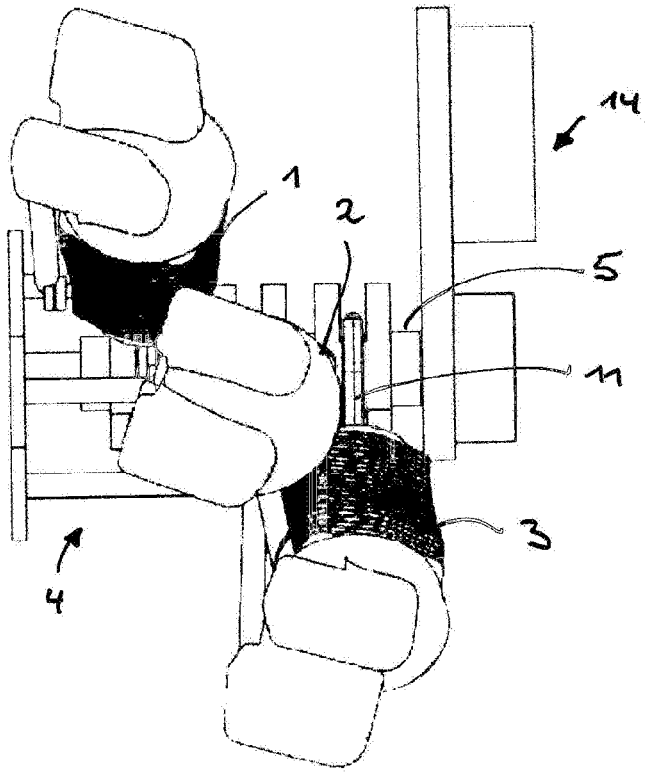
FIG. 2 is a plan view of the reciprocating piston internal combustion engine according to the embodiment of the invention.

FIG. 2 shows a plan view of the reciprocating piston internal combustion engine from FIG. 1. The fan-shaped arrangement of the cylinders 1, 2, 3 can also be seen clearly in FIG. 2.

Figure 3:
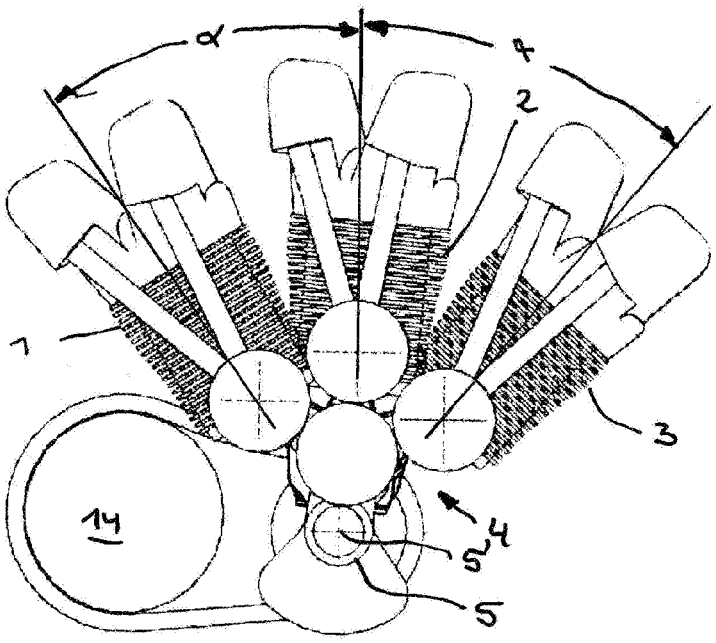
FIG. 3 is a side view of the reciprocating piston internal combustion engine according to the embodiment of the invention.

FIG. 3 shows a side view of the reciprocating piston internal combustion engine. Two cylinder angles $\alpha$ are illustrated in FIG. 3, between the adjacent cylinders 1, 2 and 2, 3. Moreover, the camshaft drives which are not provided with a designation can also be seen in FIG. 3. The adjacent cylinders 1, 2 and 2, 3 form a cylinder angle $\alpha$ which preferably lies between 20 and 90° crank angle. In a further exemplary embodiment, cylinder angles $\alpha$ of different size can also be realized between the cylinders 1, 2 and 2, 3. The ignition sequence can be influenced positively by said design variant, with the result that a different sound can be produced.

In a further preferred exemplary embodiment, a mass balancing shaft (not shown in FIGS. 1 to 4) can be driven by the crankshaft 5 and is oriented parallel to the crankshaft 5. By way of the mass balancing shaft, for example of the first order, the smooth running of the reciprocating piston internal combustion engine can be influenced positively, that is to say the NVH behavior can be improved considerably.

Figure 4:
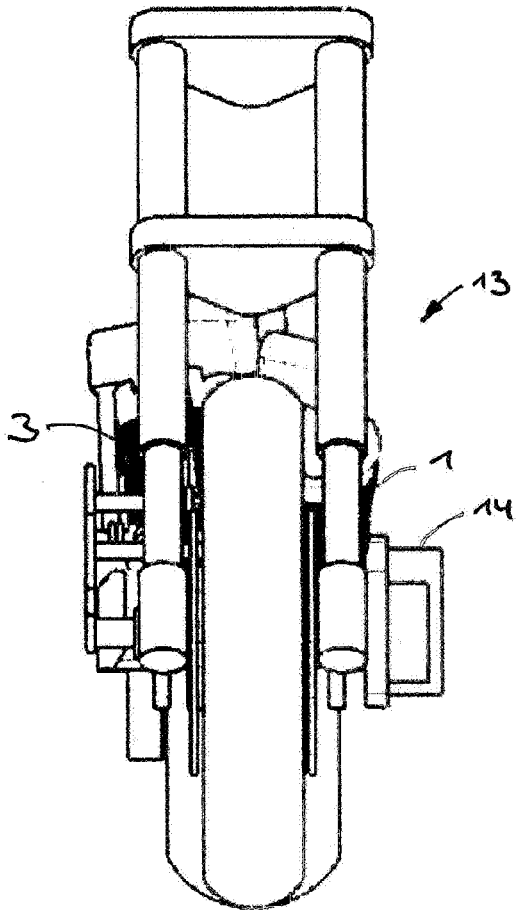
FIG. 4 is a front view of a single track vehicle having a reciprocating piston internal combustion engine according to the embodiment of the invention.

FIG. 4 shows a front view of a single track vehicle 13, in which the reciprocating piston internal combustion engine according to the invention is installed. As shown in FIG. 4, the crankshaft 5 can preferably be installed transversely with respect to a driving direction of the single track vehicle 13. The single track vehicle is preferably a motorcycle or a moped.

In comparison with other radial reciprocating piston internal combustion engines, the invention therefore makes a narrower cylinder angle α possible in the case of the existing cylinder offset. The minimum cylinder angle α is dependent on the cylinder offset, and the spacing of the crankpin journals 6, 7, 8 on the crankshaft 5.

Moreover, on account of the possible cylinder angles α, the invention makes it possible to implant a W3 reciprocating piston internal combustion engine virtually in the installation space of a V-twin reciprocating piston internal combustion engine. The overall width increases only in a noncritical range.

Accordingly, the cylinder angle α of a W4 reciprocating piston internal combustion engine is only insubstantially greater than in the case of a V4 reciprocating piston internal combustion engine.

The sound of a V-twin reciprocating piston internal combustion engine can likewise be replicated by way of a reciprocating piston internal combustion engine of this type; the sound can even be designed to be somewhat "fresher".

LIST OF DESIGNATIONS

1 First cylinder
2 Second cylinder
3 Third cylinder
4 Crank mechanism
5 Crankshaft
5' Crankshaft axis
6 First crankpin journal
7 Second crankpin journal
8 Third crankpin journal
9 First connecting rod
10 Second connecting rod
11 Third connecting rod
12 Bearing point
13 Single track vehicle
14 Output The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A reciprocating piston internal combustion engine, comprising:
first, second, and third cylinders;
a crank mechanism with a crankshaft mounted rotatably in a crankcase;
first, second, and third crankpin journals, wherein
the first crankpin journal is assigned a first connecting rod with a first piston for the first cylinder,
the second crankpin journal is assigned a second connecting rod with a second piston for the second cylinder,
the third crankpin journal is assigned a third connecting rod with a third piston for the third cylinder,
the first, second, and third crankpin journals are arranged sequentially behind one another in an axial orientation of the crankshaft,
the second cylinder is immediately adjacent to both the first and third cylinders,
relative to a first axial end of the crankshaft the first cylinder is closest to the first axial end, and
the first, second, and third cylinders are arranged like a Japanese-style hand held folding fan, such that the second cylinder is disposed in a space between the first cylinder and the third cylinder when view from the first axial end of the crankshaft.

2. The reciprocating piston internal combustion engine according to claim 1, further comprising:
one bearing point for the crankshaft being provided, in each case, between the first, second, and third crankpin journals.

3. The reciprocating piston internal combustion engine according to claim 2, wherein adjacent ones of the first, second, and third cylinders form a cylinder angle between 20° and 90° crank angle.

4. The reciprocating piston internal combustion engine according to claim 3, wherein at least two cylinder angles are unequal.

5. The reciprocating piston internal combustion engine according to claim 3, further comprising:
a mass balancing shaft drivable by the crankshaft, the mass balancing shaft being oriented parallel to the crankshaft.

6. The reciprocating piston internal combustion engine according to claim 1, wherein adjacent ones of the first, second, and third cylinders form a cylinder angle between 20° and 90° crank angle.

7. The reciprocating piston internal combustion engine according to claim 6, wherein at least two cylinder angles are unequal.

8. The reciprocating piston internal combustion engine according to claim 1, further comprising:
a mass balancing shaft drivable by the crankshaft, the mass balancing shaft being oriented parallel to the crankshaft.

9. The reciprocating piston internal combustion engine according to claim 1, wherein the reciprocating piston internal combustion engine is mounted in a single track vehicle.

10. The reciprocating piston internal combustion engine according to claim 9, wherein the crankshaft is installed transversely with respect to a driving direction of the single track vehicle.

11. The reciprocating piston internal combustion engine according to claim 1, wherein the reciprocating piston internal combustion engine is mounted in a motorcycle.

12. The reciprocating piston internal combustion engine according to claim 11, wherein the crankshaft is installed transversely with respect to a driving direction of the motorcycle.

13. The reciprocating piston internal combustion engine according to claim 1, wherein
relative to the first cylinder, the second and third cylinders are incrementally more distant from the first cylinder along a radial orientation of the crankshaft.

14. A reciprocating piston internal combustion engine, comprising:
a crankcase defining first, second, and third cylinders; and
a crankshaft mounted rotatably in the crankcase, wherein
the crankshaft has first, second, and third crankpin journals,
each crankpin journal is connected to a respective connecting rod and piston, each piston being disposed in a different cylinder,
relative to a first axial end of the crankshaft the first crankpin journal is closest to the first axial end,
the second cylinder is immediately adjacent to both the first and third cylinders, and a longitudinal axis of each cylinder extends along a different radial direction of the crankshaft such that the first, second, and third cylinders are arranged like a Japanese-style hand held folding fan, wherein the second cylinder is disposed in a space between the first cylinder and the third cylinder when view from the first axial end of the crankshaft.

15. The reciprocating piston internal combustion engine according to claim 14, further comprising:

one bearing point for the crankshaft being provided, in each case, between the first, second, and third crankpin journals.

16. The reciprocating piston internal combustion engine according to claim 15, wherein adjacent ones of the first, second, and third cylinders form a cylinder angle between 20° and 90° crank angle.

17. The reciprocating piston internal combustion engine according to claim 16, wherein at least two cylinder angles are unequal.

18. The reciprocating piston internal combustion engine according to claim 16, further comprising:

a mass balancing shaft drivable by the crankshaft, the mass balancing shaft being oriented parallel to the crankshaft.

19. The reciprocating piston internal combustion engine according to claim 14, wherein the reciprocating piston internal combustion engine is mounted in at least one of a single track vehicle and a motorcycle.

20. The reciprocating piston internal combustion engine according to claim 19, wherein the crankshaft is installed transversely with respect to a driving direction of the at least one of a single track vehicle and a motorcycle.

* * * * *